US006043018A

United States Patent [19]

Fernandez-Puente

[11] Patent Number: 6,043,018

[45] Date of Patent: Mar. 28, 2000

[54] PHOTOGRAPHIC PROCESS AND SILVER HALIDE MATERIAL USING A DEVELOPING AGENT INCORPORATED IN PARTICLES

[75] Inventor: Laurent G. Fernandez-Puente, Chalon sur Saone, France

[73] Assignee: Eastman Kodak Company, Rochester, N.Y.

[21] Appl. No.: 09/362,522

[22] Filed: Jul. 29, 1999

Related U.S. Application Data

[62] Division of application No. 09/218,196, Dec. 22, 1998, Pat. No. 5,976,773.

[30] Foreign Application Priority Data

Dec. 22, 1997 [FR] France ..... 97 16595

[51] Int. Cl.[7] ..... G03C 1/047

[52] U.S. Cl. ..... 430/566; 430/448

[58] Field of Search ..... 430/566, 448

[56] References Cited

U.S. PATENT DOCUMENTS

| | | | |
|---|---|---|---|
| 4,275,145 | 6/1981 | Mikami | 430/217 |
| 4,789,616 | 12/1988 | Croucher et al. | 430/137 |
| 5,578,411 | 11/1996 | Slater et al. | 430/566 |
| 5,834,169 | 11/1998 | Thomas | 430/405 |

FOREIGN PATENT DOCUMENTS

| | | |
|---|---|---|
| 0609878A1 | 2/1993 | European Pat. Off. . |
| 0802452A1 | 4/1996 | European Pat. Off. . |

*Primary Examiner*—Hoa Van Le
*Attorney, Agent, or Firm*—J. Lanny Tucker

[57] ABSTRACT

The invention relates to a silver halide photographic process carried out using a developing agent incorporated in particles. The developing agent is present in the particles along with a phospholipid-type surfactant. These particles are placed, upon development, in contact with the exposed silver halide photographic material, in the presence of an alkaline activator.

5 Claims, 1 Drawing Sheet

PHOTOGRAPHIC PROCESS AND SILVER HALIDE MATERIAL USING A DEVELOPING AGENT INCORPORATED IN PARTICLES

CROSS-REFERENCE TO RELATED APPLICATION

This is a Divisional of application Ser. No. 09/218,196 filed Dec. 22, 1998, now U.S. Pat. No. 5,976,773.

FIELD OF THE INVENTION

This invention relates to a photographic process to obtain an image in a material comprising light-sensitive silver halides by placing the material in contact with particles containing a silver halide developing agent in the presence of an activator. This invention also relates to a photographic material for the implementation of this process.

BACKGROUND OF THE INVENTION

A conventional process in photography is to imagewise expose a silver halide emulsion layer, then to develop the resulting latent image with an alkaline solution of a silver halide developing agent, such as hydroquinone, to obtain a silver image in the latent image areas. Usually, the image thereby obtained is then fixed.

It has been contemplated to incorporate the developing agent in the photographic material, for example, in the silver halide emulsion layer. In this case, the development of the exposed emulsion can be set off simply by applying an aqueous alkaline solution. If the alkali is also incorporated in the photographic material, the development can be triggered simply by a water washing.

Systems of this type, incorporating all the ingredients necessary for development, have been described for example in French Patents Nos. 1 257 893, 1 500 987, 1 591 741, and in British Patent No. 999 247.

A current tendency is thus to simplify the processing of halide photographic materials, especially by incorporating the developing agent in the photographic material. However, the coexistence in the same material of the light-sensitive silver halides and the developing agent brings its own problems, especially concerning stability and keeping conditions.

The purpose of this invention is to solve this problem by providing a process that uses a silver halide developing agent incorporated in particles also containing surfactants.

SUMMARY OF THE INVENTION

Accordingly, the object of this invention is the use of particles containing a silver halide developing agent to form an image in a light-sensitive silver halide emulsion layer of a photographic material. Specifically, the object of this invention is a process for providing an image in a photographic material having at least one light-sensitive silver halide emulsion layer, the method comprising:

(a) imagewise exposing the photographic material; and (b) placing the exposed photographic material in interactive contact with a composition comprising a binder in which are dispersed particles containing a silver halide developing agent and at least one phospholipid-type surfactant, the interactive contacting taking place in the presence of an alkaline activator.

There is also provided photographic material comprising (i) a support, (ii) at least one light-sensitive silver halide emulsion layer, and (iii) particles containing a developing agent and at least one surfactant of a naturally-occurring or synthetic phospholipid type with a gel/liquid crystal phase transition temperature below 6° C.

DETAILED DESCRIPTION OF THE INVENTION

Figure 1:
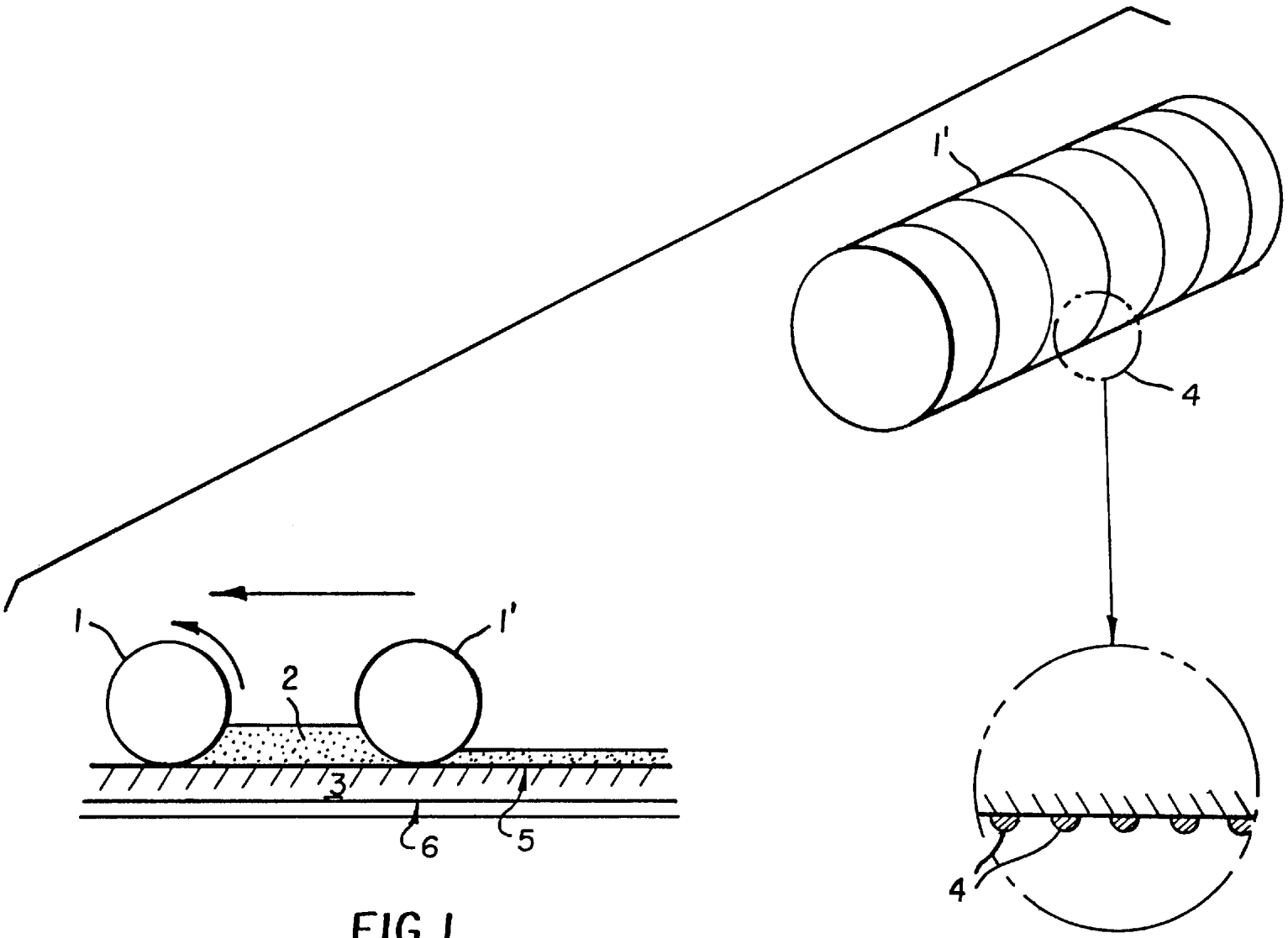

Phospholipids are compounds generally obtained by esterification of two OH functions of glycerol with fatty carboxylic acids of which the alkyl chain comprises 12 to 14 carbon atoms, and esterification of the third OH function of glycerol with phosphoric acid. The phospholipids useful in the invention are neutral naturally-occurring or synthetic compounds with gel/liquid crystal phase transition temperature below 6° C. The phospholipid has to be liquid in the specified range of operating conditions, for example from 10° C. to 70° C. Lecithin is preferably used as the phospholipid, for example from soy or eggyolk.

The term 'interactive' means the contact allows a reaction to take place between the exposed light-sensitive emulsion and the developing agent incorporated in the particles, in the presence of a photographic activator, i.e., an aqueous alkali affording a pH preferably equal to or greater than 10.

The solvent, given the nature of the substance to be incorporated in the particles (a hydroquinone-type developing agent), is an oleophilic compound such as an alkyl ester, e.g., dibutyl phthalate, dibutyl sebaceate, tricresyl phosphate, 1,4-cyclohexane dimethanol-bis-(2-ethylhexanoate), etc. Solvent mixtures can be used.

In an embodiment, the mixture of developing agent and solvent is mixed at a temperature of from 80 to 120° C. depending on the nature of the solvent under an inert atmosphere with stirring. The concentration depends on the developing agent and the solvent, but can be for example from 20 to 60% by weight of developing agent relative to the total mass of developing agent plus solvent.

In practice, 0.5 to 20%, and preferably 5 to 15% by weight of surfactant relative to the quantity of solvent is used.

The particle size is measured by polarized light microscopy or by turbidimetry.

Particle size can be from 0.1 to 10 $\mu$m, and advantageously from 0.2 to 0.5 $\mu$m.

The particles obtained by this method are monodisperse (dispersity less than 20%, and preferably less than 10%). They are highly stable, thus allowing to use them with no special precautions to prepare dispersions to obtain photographic layers.

To prepare a composition comprising coatable particles, conventional binders and dispersants for photographic layers can be used. These binders and dispersants are hydrophilic colloids, essentially protein substances in aqueous dispersion, such as aqueous dispersions of gelatin or modified gelatin, e.g., phthalylated or acetylated gelatin. Such substances are for example described in Research Disclosure No. 36544, September 1994, page 507, Photographic Silver Halide Emulsions, Preparations, Addenda, Systems and Processing, Section II, A. The above example provides a procedure to obtain such a dispersion with gelatin.

Additionally, the dispersions can contain additives to improve mechanical properties, preservatives, antioxidants, anti-UV agents, hardeners, and viscosity controlling agents. The dispersions are coated by conventional coating methods used in photography. All these aspects are described, with references, in the above-mentioned Research Disclosure.

The composition containing the particles can be coated as an integral layer of a photographic material comprising a support and at least one light-sensitive silver halide layer. The layer containing the particles can be placed between the support and the light-sensitive layer(s). Application of the activator onto the exposed photographic material will allow the aforementioned interactive contact between the silver halides, the particles and the activator.

Alternatively a layer of the composition containing the particles can be placed in contact with an exposed photographic material in the presence of an activator upon development, in order to obtain the aforementioned interactive contact.

Whichever the case, the particles release the incorporated developing agent in the presence of an activator, i.e., an aqueous solution comprising an alkali such as sodium or potassium hydroxide, or an alkaline carbonate, able to provide a pH greater than 10, and preferably greater than 12. The activator can also contain conventional additives such as sulfite, antifogging agent, development accelerators, and wetting agents.

The developing agent is of the alkyl hydroquinone type, where the alkyl chain preferably contains 1 to 5 carbon atoms, e.g., methyl, ethyl, isopropyl, t-butyl, or of the phenidone or substituted phenidone type. The particles can contain one or more developing agents in synergetic association.

Application of the activator can be performed by any known means that especially allows an aqueous solution to be coated evenly on a plane support to produce a layer. This application can be manual or automated. For example, such a layer can be obtained by spraying, soaking, vaporization or coating.

In an embodiment, the process of the invention comprises an additional step that consists in removing excess activator. This step can be performed by means of a doctor blade, a wiper, an absorbing material, etc.

In a embodiment, the activator is applied using the device illustrated in FIG. 1 which comprises a set of two rollers, front 1 and rear 1', driven together. The space between the two rollers forms a reservoir holding the activator to be spread 2. The device is placed on the surface of the photographic material 3 to be processed, the material lying on a support equipped with a heater 6. The front roller 1 is covered with flexible rubber, and the rear roller has a grooved surface 4, which controls the spreading of the activator 5. The device is equipped with a motor (not illustrated) to move the pair of rollers automatically along the photographic material and thereby deposit a thin, even layer of activator onto the material.

With the device and the process of this invention, photographic materials can be processed in a highly satisfactory and reproducible way with a volume of activator from 20 to 200 ml/m$^2$ , preferably from 20 to 100 ml/m$^2$ or even from 20 to 50 ml/m$^2$.

Any type of photographic material can be processed in this way, i.e., photographic negative color materials, color reversal materials, black-and-white photographic materials such as radiographic materials, or materials for graphics.

Photographic materials conventionally comprise a support having on at least one side thereof a silver halide emulsion layer. These photographic materials are described in *Research Disclosure,* September 1994, 368, No. 36544 (referred to hereafter as *Research Disclosure*).

The silver halide emulsion is made up of silver halide grains in a hydrophilic binder, e.g., gelatin. Different preparation methods of these emulsions have been described in *Research Disclosure,* sections I.A. to I.C. Gelatin can be replaced in part by other synthetic or naturally-occurring hydrophilic colloids, such as albumin, casein, zein, a polyvinyl alcohol, cellulose derivatives, e.g., carbomethylcellulose. Such colloids are described in *Research Disclosure,* section II. Silver halide grains can be of different shapes (see section 1-B of *Research Disclosure*).

*Research Disclosure,* section 1-A describes the silver halide compositions of these grains. The silver halide grains can contain chloride, bromide, chlorobromide, bromochloride, chloroiodide, bromoiodide or bromochloriodide. In a preferred embodiment, the emulsion contains mainly silver chloride, i.e., more than 50 mole % of silver chloride relative to the total quantity of silver halides in the emulsion.

Silver halide grains can be chemically sensitized as described in *Research Disclosure,* section IV.

Silver halide grains can be spectrally sensitized as described in *Research Disclosure,* section V.

In addition to the above-mentioned compounds, the photographic material can contain other photographically useful compounds, e.g., coating aids, stabilizers, plasticizers, antifogging agents, hardeners, antistatic agents, matting agents, etc. Examples of these compounds are described in *Research Disclosure,* sections VI, VII, VIII, X.

Supports that can be used in photography are described in *Research Disclosure,* section XV. These supports are generally polymeric supports such as cellulose polymers, polystyrenes, polyamides, vinyl polymers, polyethylenes, polyesters, and paper or metal supports.

Photographic materials can contain additional layers, e.g., a protective overcoat layer, interlayers, an antihalo layer, an antistatic layer, etc. These different layers and their arrangement are described in Research Disclosure, section XI.

The invention is described in more detail in the following examples:

EXAMPLES

Preparation of particles containing a developing agent 80 g of t-butyl hydroquinone were dissolved in 90 g of dibutyl sebaceate, with stirring for 30 minutes at 1 10C under a nitrogen atmosphere.

In a mixer, 9 g of soy lecithin and a 15% aqueous gelatin solution so as to introduce the equivalent of 50 g of dry gelatin, were added to this solution of t-butyl hydroquinone. To this gelatin solution was added 0.05% by weight of $Na_2S_2O_5$ (protection against oxidation). The mixture was stirred for 2 minutes at 50° C.

The mixture was then treated three times for 20 minutes in a Rannie Mill MINILAB model type 8.30 H homogenizer under a pressure of 600 bars (60 MPa). A homogeneous paste was obtained containing particles having an average diameter of 0.32 $\mu$m.

This composition was used in the following example to prepare a layer for the development of a silver halide photographic material.

EXAMPLE 1

On an ESTAR® polyethylene terephthalate support were successively coated:

(1) a gelatin layer (1.8 g/m$^2$) containing 3.5% by weight relative to the gelatin contained in the 3 layers, of bis-(vinylsulfonyl)methane (hardener), 0.4 g/m$^2$ of latex (acrylic terpolymer), a quantity of the composition prepared above, such as to obtain 1.5 g/m$^2$ of t-butyl hydroquinone, and lastly 0.1 g/m$^2$ of 4-hydroxymethyl-4-methyl-1 -phenyl pyrazolidone (HMMP);

(2) a silver chlorobromide cubic grain (0.2 $\mu$m) emulsion layer (70 mole % of chloride) containing per m$^2$; 2.8 g of silver and 1.75 g of gelatin; this emulsion was doped with rhodium and chemically sensitized with sulfur ($2.98\times10^{18}$ atoms of sulfur per mole of Ag) and gold ($3.50\times10^{18}$ atoms of gold per mole of Ag) and spectrally red sensitized;

(3) an overcoat layer of gelatin (8 g/m$^2$).

This photographic material was exposed through an 18-step (step of 0.1) wedge chart with a xenon flash exposure meter for 2 $\mu$sec through a Wratten W29 filter.

The exposed material was processed with an applicator of the type schematically illustrated in FIG. 1. In the space enclosed by the two rollers 1 and 1', was introduced 2 ml of an activator solution 2, the composition of which is given below:

| Activator: | |
|---|---|
| 5-nitroindazole | 0.2 g/l |
| 2-methylaminoethanol | 70.0 g/l |
| KBr | 5.0 g/l |
| $K_2SO_3$ | 99.0 g/l |
| 1-phenethyl-2-methylpyridinium bromide | 2.0 g/l |
| Wetting agent LODYNE/S 100 ®* | 30 ml/l |
| pH 12 | |

*25% aqueous solution.

The set of two rollers was driven over the surface of the film to be processed. A layer of activator solution was thus formed, which permits the development of the film. The two rollers were then driven in the reverse direction to remove excess activator solution. In this embodiment the activator solution remained in contact with the film for 20 seconds. The development temperature was 22° C. The film was then placed in a stop bath (30 seconds), a fixing bath (RP X-OMAT fixer, 1 minute at 25° C.) followed by a washing bath (2 minutes). A developed silver image was obtained, the characteristics of which are given in Table I.

EXAMPLE 2

The procedure of Example 1 was followed, except that 120 g of 1,4-cyclohexanedimethanol-bis(2-ethylhexanoate) was used as solvent for the t-butyl hydroquinone, and 12 g of lecithin was used. After exposure and processing, as in Example 1, the sensitometric characteristics given in Table I are obtained by densitometry.

TABLE I

| Example | Dmin | Dmax | Speed | Contrast |
|---|---|---|---|---|
| 1 | 0.036 | 3.879 | 336.4 | 6.77 |
| 2 | 0.034 | 3.886 | 334.1 | 7.04 |

Dmin (density of the support+fog)

Dmax (point of maximum density)

Contrast: slope of the sensitometric curve measured between densities 0.1 and 2.5

Speed: speed of film measured at a density of 2 above Dmin.

The invention has been described in detail with particular reference to certain preferred embodiments thereof, but it will be understood that variations and modifications can be effected within the spirit and scope of the invention.

What is claimed is:

1. A photographic material comprising (i) a support, (ii) at least one light-sensitive silver halide emulsion layer, and (iii) particles containing a developing agent and at least one surfactant of a naturally-occurring or synthetic phospholipid type with a gel/liquid crystal phase transition temperature below 6° C.

2. The photographic material of claim 1 wherein said particles are incorporated in a layer adjacent to said light-sensitive silver halide emulsion layer.

3. The photographic material of claim 1 wherein said particles contain a hydroquinone-type developing agent, a solvent for the developing agent, and lecithin.

4. The photographic material of claim 1 wherein said particles further contain a solvent for said developing agent, and said surfactant is present in an amount of from 0.5 to 20% relative to the amount of said solvent.

5. The photographic material of claim 1 wherein said particles have a size of from 0.1 to 10$\mu$m.

* * * * *